US007245862B2

(12) United States Patent
Ebara

(10) Patent No.: US 7,245,862 B2
(45) Date of Patent: Jul. 17, 2007

(54) METHOD OF ADJUSTING ROTATIONAL PHASE OF IMAGE CARRYING MEMBERS IN IMAGE FORMING APPARATUS

(75) Inventor: Joh Ebara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 119 days.

(21) Appl. No.: 11/080,850

(22) Filed: Mar. 16, 2005

(65) Prior Publication Data

US 2005/0207799 A1 Sep. 22, 2005

(30) Foreign Application Priority Data

Mar. 17, 2004 (JP) ..... 2004-076553

(51) Int. Cl.
*G03G 15/01* (2006.01)

(52) U.S. Cl. ..... 399/299; 399/301; 399/302

(58) Field of Classification Search ..... 399/299, 399/301, 302

See application file for complete search history.

(56) References Cited

U.S. PATENT DOCUMENTS

| | | | | |
|---|---|---|---|---|
| 6,278,857 | B1 * | 8/2001 | Monji et al. | 399/301 |
| 6,788,914 | B1 * | 9/2004 | Wasai | 399/301 |
| 2003/0128995 | A1 * | 7/2003 | Ishii et al. | 399/49 |

FOREIGN PATENT DOCUMENTS

| | | | |
|---|---|---|---|
| JP | 09-146329 | A | 6/1997 |
| JP | 11-184279 | A | 7/1999 |
| JP | 2001-042671 | A | 2/2001 |
| JP | 2001-109355 | A | 4/2001 |
| JP | 2001-305882 | A | 11/2001 |
| JP | 2002-123128 | A | 4/2002 |
| JP | 2002-214969 | A | 7/2002 |
| JP | 2002-243007 | A | 8/2002 |
| JP | 2002-255400 | A | 9/2002 |
| JP | 2003-084641 | A | 3/2003 |
| JP | 2003-323077 | A | 11/2003 |
| JP | 2003-337457 | A | 11/2003 |

* cited by examiner

*Primary Examiner*—David M. Gray
*Assistant Examiner*—Joseph S. Wong
(74) *Attorney, Agent, or Firm*—Harness, Dickey & Pierce

(57) ABSTRACT

A first pattern having lines of a first color and a second pattern having lines of a second color are formed on an image transferring member near the side edges thereof. Each of the first and second color lines are sequentially detected by a sensor. Absolute values of time differences between detection of first lines and corresponding second lines are calculated. This process of detection of the time differences is repeated several times while changing the rotational phase of the an image carrying member for the second color. A position where the time difference is relatively lowest or even the minimum is selected.

19 Claims, 4 Drawing Sheets

METHOD OF ADJUSTING ROTATIONAL PHASE OF IMAGE CARRYING MEMBERS IN IMAGE FORMING APPARATUS

PRIORITY STATEMENT

The present application claims priority and contains subject matter related to Japanese Patent Application No. 2004-076553 filed in the Japanese Patent Office on Mar. 17, 2004, the entire contents of which are hereby incorporated herein by reference.

BACKGROUND

It is known that in an image forming apparatus that has a plurality of image carrying members, which superimpose toner images onto an image transferring member or directly onto a recording sheet (such as paper, for example), a positional deviation of toner images occurs because of fluctuations in the rotational speed of respective image carrying members. In some conventional image forming apparatuses, a pattern is formed on the image transferring member, the positional deviation caused by the fluctuation in the rotational speed of the image carrying members is calculated, and the rotational speed of the image carrying members is controlled to compensate for the positional deviation. Such a conventional technology is disclosed in Japanese Patent Application Laid-Open Publication No. H9-146329. However, if the pattern itself has a positional deviation, precision of compensating for the positional deviation declines.

SUMMARY

A method according to an aspect of an embodiment of the present invention includes a method of adjusting rotational phase of a plurality of image carrying members in an image forming apparatus that includes an image transferring member on which are superimposed toner images that are formed on each of the image carrying members; a plurality of reference points, each reference point corresponds to a reference rotational position of a corresponding image carrying member; and a plurality of detecting units, each detecting unit detects a corresponding reference point. The method includes designating, e.g. setting, one image carrying member as a reference image carrying member; forming, after each detecting unit detects the reference rotational position of the corresponding image carrying member, a toner image of a pattern on each image carrying member and transferring the toner images onto the image transferring member; detecting elapsed time differentials of each toner image transferred from the image carrying members other than the reference image carrying member based on the toner image transferred from the reference image carrying member, in a direction of movement at a fixed position on the image transferring member; calculating a sum of absolute values of the elapsed time differentials for each toner image and storing the sums as fluctuations in rotational speed of each image carrying member; adjusting rotational phases of the image carrying members other than the reference image carrying member with respect to a rotational phase of the reference image carrying member, and repeating the forming, the detecting, and the calculating at substantially the same position on the image transferring member, to thereby obtain fluctuations in the rotational speed of each image carrying member for a plurality of sets; and selecting the position where the fluctuation in the rotational speed is relatively lowest or even minimum for each image carrying member.

A method according to another aspect of an embodiment of the present invention is a method of adjusting rotational phase of a plurality of image carrying members in an image forming apparatus that includes an image transferring member on which are superimposed toner images that are formed on each of the image carrying members; a reference point at a reference position on the image transferring member; and a detecting unit that detects the reference point. The method includes designating, e.g. setting, one image carrying member as a reference image carrying member; forming, after the detecting unit detects the reference point, a toner image of a pattern on each image carrying member and transferring the toner images onto the image transferring member; detecting elapsed time differentials of each toner image transferred from the image carrying members other than the reference image carrying member based on the toner image transferred from the reference image carrying member, in a direction of movement at a fixed position on the image transferring member; calculating a sum of absolute values of the elapsed time differentials for each toner image and storing the sums as fluctuations in rotational speed of each image carrying member; adjusting rotational phases of the image carrying members other than the reference image carrying member with respect to a rotational phase of the reference image carrying member, and repeating the forming, the detecting, and the calculating, to thereby obtain fluctuations in the rotational speed of each image carrying member for a plurality of sets; and selecting the position where the fluctuation in the rotational speed is relatively lowest or even minimum for each image carrying member.

An image forming apparatus according to still another aspect of an embodiment of the present invention includes a plurality of image carrying members; an image transferring member on which are superimposed toner images that are formed on each of the image carrying members; a plurality of reference points, each reference point corresponds to a reference rotational position of a corresponding image carrying member; and a plurality of detecting units, each detecting unit detects a corresponding reference point. First, (a), one image carrying member is designated, e.g. set, as a reference image carrying member. Then, (b), after each detecting unit detects the reference rotational position of the corresponding image carrying member, a toner image of a pattern is formed on each image carrying member and the toner images are transferred onto the image transferring member. Next, (c), elapsed time differentials of each toner image transferred from the image carrying members other than the reference image carrying member are detected based on the toner image transferred from the reference image carrying member, in a direction of movement at a fixed position on the image transferring member. Thereafter, (d), a sum of absolute values of the elapsed time differentials is calculated for each toner image and the sums are stored as fluctuations in rotational speed of each image carrying member. Further, (e), rotational phases of the image carrying members other than the reference image carrying member are adjusted with respect to a rotational phase of the reference image carrying member, and (b), (c), and (d) are repeated at substantially the same position on the image transferring member, to thereby obtain fluctuations in the rotational speed of each image carrying member for a plurality of sets. Finally, (f), the position where the fluctuation in the rotational speed is relatively lowest or even minimum is selected for each image carrying member.

An image forming apparatus according to still another aspect of an embodiment of the present invention includes a plurality of image carrying members; an image transferring member on which are superimposed toner images that are formed on each of the image carrying members; a reference point at a reference position on the image transferring member; and a detecting unit that detects the reference point. First, (a), one image carrying member is designated, e.g. set, as a reference image carrying member. Then, (b), after the detecting unit detects the reference point, a toner image of a pattern is formed on each image carrying member and the toner images are transferred onto the image transferring member. Next, (c), elapsed time differentials of each toner image transferred from the image carrying members other than the reference image carrying member are detected based on the toner image transferred from the reference image carrying member, in a direction of movement at a fixed position on the image transferring member. Thereafter, (d), a sum of absolute values of the elapsed time differentials is calculated for each toner image and the sums are stored as fluctuations in rotational speed of each image carrying member. Further, (e), rotational phases of the image carrying members other than the reference image carrying member are adjusted with respect to a rotational phase of the reference image carrying member, and (b), (c), and (d) are repeated to thereby obtain fluctuations in the rotational speed of each image carrying member for a plurality of sets. Finally, (f), the position where the fluctuation in the rotational speed is relatively lowest or even minimum is selected for each image carrying member.

DETAILED DESCRIPTION OF EXAMPLE EMBODIMENTS

Example embodiments of the present invention will be described below with reference to accompanying drawings.

Figure 1:
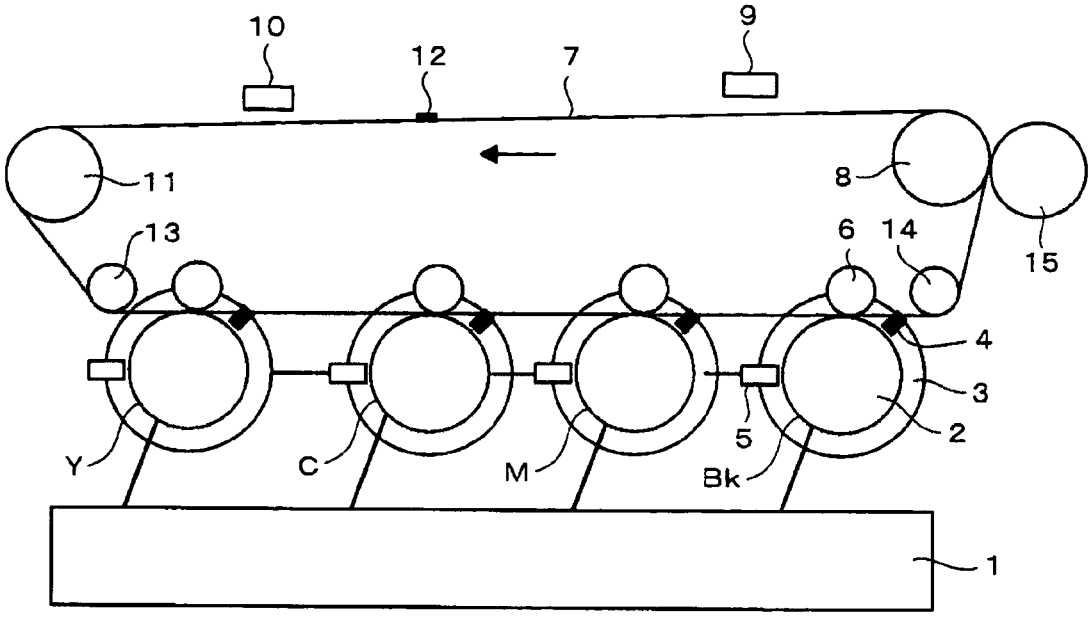
FIG. 1 is a schematic side view of an overall configuration of an embodiment according to the present invention.

FIG. 1 is a schematic side view of an overall configuration of an image forming apparatus according to an embodiment of the present invention. This image forming apparatus includes an image writing device 1; four drum-shaped image carrying members Bk, M, C, and Y that revolve in a clockwise direction; an image-carrying-member driving-gear 3 corresponding to each image carrying member; a marking 4 on each image-carrying-member driving-gear 3; an image-carrying-member position-sensor 5, corresponding to each image carrying member, that detects a reference position of the image carrying member; a bias roller 6 corresponding to each image carrying member; a belt-type image transferring member 7; a driving roller 8; toner-pattern detecting sensors 9; an image-transferring-member position-sensor 10 that detects a reference position on the image transferring member 7; subordinate driving rollers 11, 13, and 14; a marking 12 on the image transferring member 7, and an image transferring roller 15.

Although not shown, an electrostatic discharge device, a toner image developing device, a drum cleaning device and the like, may be arranged around each image carrying member. The four image carrying members include a black-image carrying member Bk that carries a black (Bk) toner image, a magenta-image carrying member M that carries a magenta (M) toner image, a cyan-image carrying member C that carries a cyan (C) toner image, and a yellow-image carrying member Y that carries a yellow (Y) toner image. The configuration of the image carrying members M, C, and Y is identical to that of the image carrying member Bk. Unless specified, a term "image carrying members 2" will generally be used to refer to each or all of the image carrying members Bk, M, C, and Y in a generic fashion.

The image writing device 1 is positioned below the image carrying members 2. The image transferring member 7 winds around the driving roller 8, the subordinate driving rollers 11, 13, and 14, and the bias rollers 6. The image transferring member 7 comes into contact with an image carrying member via a corresponding bias roller 6. The image-carrying-member position-sensor 5 detects the marking 4 on the corresponding image-carrying-member driving-gear 3 to detect the position of the corresponding image carrying member in a sheet-feeding direction (rotational direction).

The image-transferring-member position-sensor 10 detects the position of the image transferring member 7 by detecting the marking 12. The toner-pattern detecting sensors 9 are positioned perpendicular to the sheet-feeding direction of the image transferring member 7 (lateral view of the cross-section in FIG. 1). A recording sheet, for example a recording paper, transparency, etc. is inserted in a nip between the driving roller 8 and the image transferring roller 15. The image transferring roller 15 transfers the toner image, which is formed on the image transferring member 7, onto the recording sheet.

Figure 2:
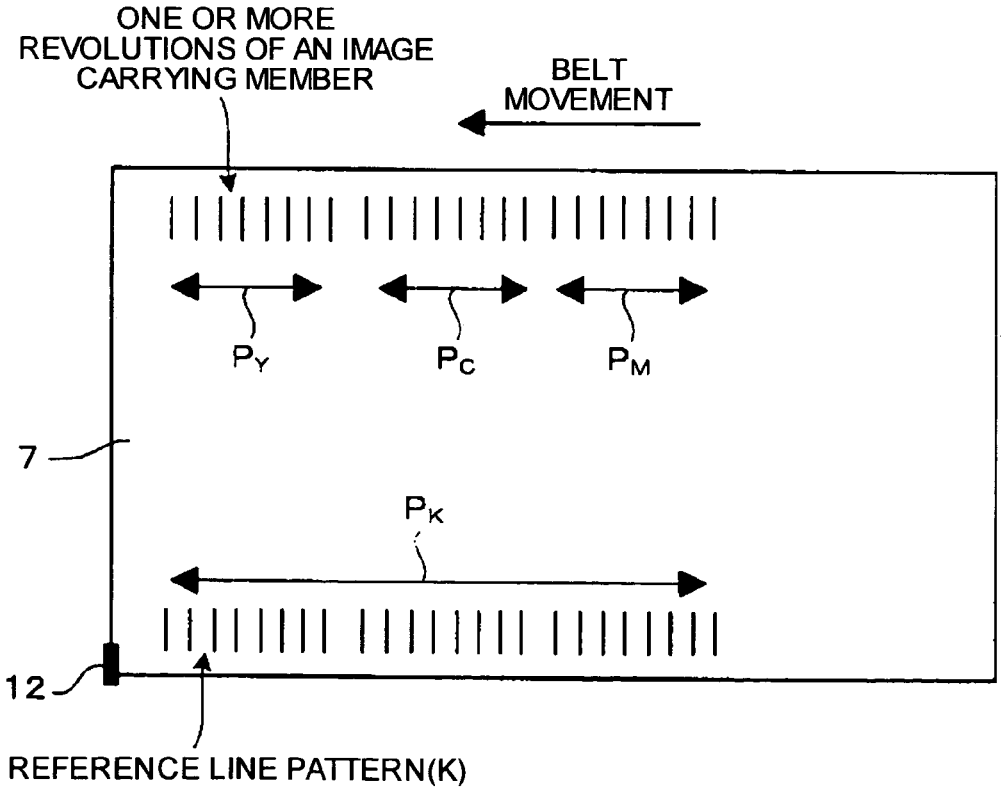
FIG. 2 is a diagram of patterns used for detecting fluctuations in a rotational speed of image carrying members.
Figure 3:
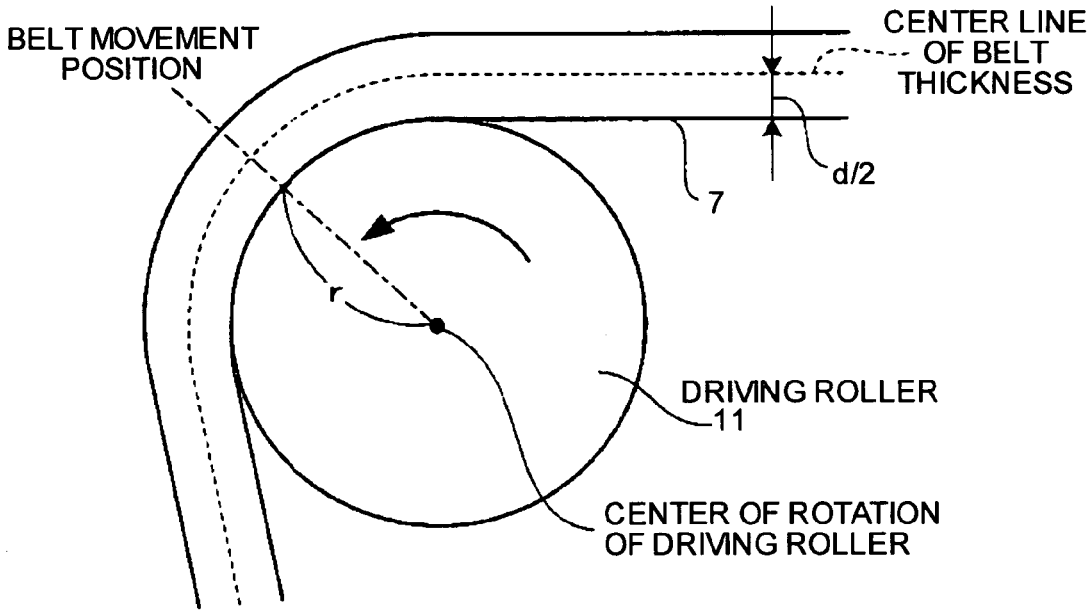
FIG. 3 is a schematic for explaining why fluctuations occur in the rotational speed of the image transferring member.
Figure 4:
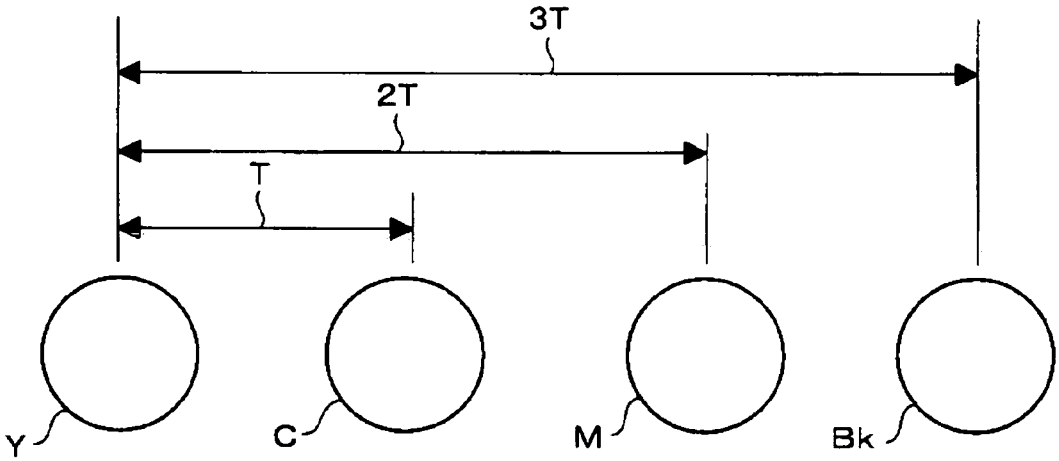
FIG. 4 is a simplified diagram of distances between photosensors of each image carrying member.

FIG. 2 is a schematic of patterns formed with toner on the image transferring member 7. These patterns are used for detecting fluctuations in a rotational speed of the image carrying members 2. FIG. 3 is a schematic for explaining why fluctuations occur in the rotational speed of the image transferring member 7. FIG. 4 is a schematic for explaining the positional relationship between the photosensors of the image carrying members 2.

In FIG. 2, reference signs $P_K$, $P_y$, $P_C$, $P_M$ denote black, yellow, cyan and magenta images, which are in the form of lines (hereinafter, "line images"), respectively. The line images include a plurality of short, thin lines, at a fixed pitch, perpendicular to the direction of movement of the image transferring member 7. The line images $P_K$ are formed on the image transferring member 7 by the black image carrying member Bk for a length of at least one rotation of the black image carrying member Bk.

Each of the line images of yellow $P_y$, cyan $P_C$ and magenta $P_M$ are formed using the black line image $P_K$ as a reference. The toner-pattern detecting sensors 9 sense these line images. Although black line images are used as the reference line images in the present embodiment, a line image of any other color can also be used.

FIG. 3 is a schematic for explaining why fluctuations occur in the rotational speed of the image transferring member 7. FIG. 3 illustrates that the image transferring member 7 is wound around the driving roller 11. It is assumed that the radius, which is fixed, of the driving roller 11 is r and the thickness of the image transferring member 7 is d. In this case, it is generally presumed that the speed of the image transferring member 7 is equal to the speed at the position of the average radius Ra; expressed as Ra=r+d/2, although this depends on the angle at which the image transferring member 7 is wound. If the angular speed of the driving roller 11 is ω1, the speed v of the image transferring member 7 can be represented as follows:

$$v=Ra\cdot\omega 1$$

$$a.=(r+d/2)\cdot\omega 1 \quad (1).$$

If the angular speed ω1 of the driving roller 11 and the thickness d of the image transferring member 7 are constant, the speed v of the image transferring member 7 is constant. However, a deviation Δd occurs in the thickness of the image transferring member 7 during rotation, and the deviation changes smoothly. The variation of the average radius is assumed to be $(\Delta d/2)\cdot\cos(\omega 2\cdot t+\theta)$, where ω2 is the angular speed of the driving roller 11 when the image transferring member 7 is considered to be in a form of a circle, and θ is an initial phase. Accordingly, based on equation (1), the speed v of the image transferring member 7 having a deviation of thickness can be represented as follows:

$$v=(r+(d/2)+(\Delta d/2)\cdot\cos(\omega 2\cdot t+\theta))\cdot\omega 1 \quad (2).$$

Thus, if the thickness of the image transferring member 7 varies, the speed v of the image transferring member 7 becomes function of time, that is, the speed v changes with time.

A change in the speed, Δv, of the image transferring member 7 can be obtained by subtracting equation (1) from equation (2) as follows:

$$\Delta v=(\Delta d/2)\cdot\cos(\omega 2\cdot t+\theta)\cdot\omega 1 \quad (3).$$

As illustrated in FIG. 4, the time required for the image transferring member 7 to move from one image carrying member to the adjacent image carrying member is defined as T, and there are four image carrying members in the order of yellow, cyan, magenta, and black, highest deviation is generated between yellow and black. General time deviation Δy can be obtained by time differentiating equation (3) as follows:

$$\Delta y=\int(\Delta d/2)\cdot\cos((\omega 2\cdot t+\theta)\cdot\omega 1\cdot dt$$

$$i.=\{(\Delta d/2)\cdot(\omega 1/\omega 2)\cdot\sin(\omega 2\cdot t+\theta)\} \quad (4).$$

It is noted that dt is a symbol for a differential (in this calculus).

If the length of the inner circumference of the image transferring member 7 is L, the speed v of the image transferring member can be expressed as follows:

$$v=\omega 1\cdot(r+d/2)$$

$$a.=\omega 2\cdot(L/2\pi+d/2) \quad (5).$$

From the equations (4) and (5), the deviation Δy between the image carrying members 2 can be expressed as $$\Delta y=\Delta d/2\cdot((L/2\pi+d/2)/(r+d/2))\cdot((\sin(v/(L/2\pi$$

$$i.+d/2)\cdot 3T+\theta)-\sin\theta) \quad (6).$$

If the distance between two adjacent image carrying members is p, then p=vT, and the equation (6) can be expressed as a function of distance as $$\Delta y=\Delta d/2\cdot((L/2\pi+d/2)/(r+d/2))\cdot((\sin(3p/(L/2\pi$$

$$i.+d/2)\cdot\theta)-\sin\theta) \quad (7).$$

If the positional deviation of an image formed on the image transferring member 7 is ΔL, the sensed deviation can be obtained from equation (7), as follows:

$$\Delta y=\Delta d/2\cdot((L/2\pi+d/2)/(r+d/2))\cdot(\sin(3p/(L/2\pi$$

$$i.+d/2)+2\pi\cdot\Delta L/L)-\sin((2\pi\cdot\Delta L/L)+\theta)) \quad (8).$$

An acceptable value of the positional deviation of a toner image is about 100 micrometers (μm), so the sensed deviation is Δy<100 μm. Therefore, the acceptable deviation is expressed as $$\Delta d/2\cdot((L/2\pi+d/2)/(r+d/2))\cdot(\sin(3p/(L/2\pi$$

$$a.+d/2)+(2\pi\cdot\Delta L/L)+\theta)-\sin((2\pi\cdot\Delta L/L)+\theta))<100\ \mu m \quad (9).$$

If the number of image carrying members is n, based on equation (9), the acceptable deviation is expressed as $$\Delta d/2\cdot((L/2\pi+d/2)/(r+d/2))\cdot(\sin(n-1)p/(L/2\pi$$

$$a.+d/2)+(2\pi\cdot\Delta L/L)+\theta)-\sin((2\pi\cdot\Delta L/L)+\theta))<100\ \mu m \quad (10).$$

The deviation of thickness is 20 μm if the image transferring member is a polyimide belt. Therefore, the acceptable deviation of the toner image is expressed by substituting Δd/2=10 in equation (10), as follows:

$$(L/2\pi+d/2)/(r+d/2))\cdot(\sin((n-1)p/(L/2\pi$$

$$i.+d/2)+(2\pi\cdot\Delta L/L)+\theta)-\sin((2\pi\cdot\Delta L/L)+\theta)<10\ \mu m \quad (11).$$

Figure 5:
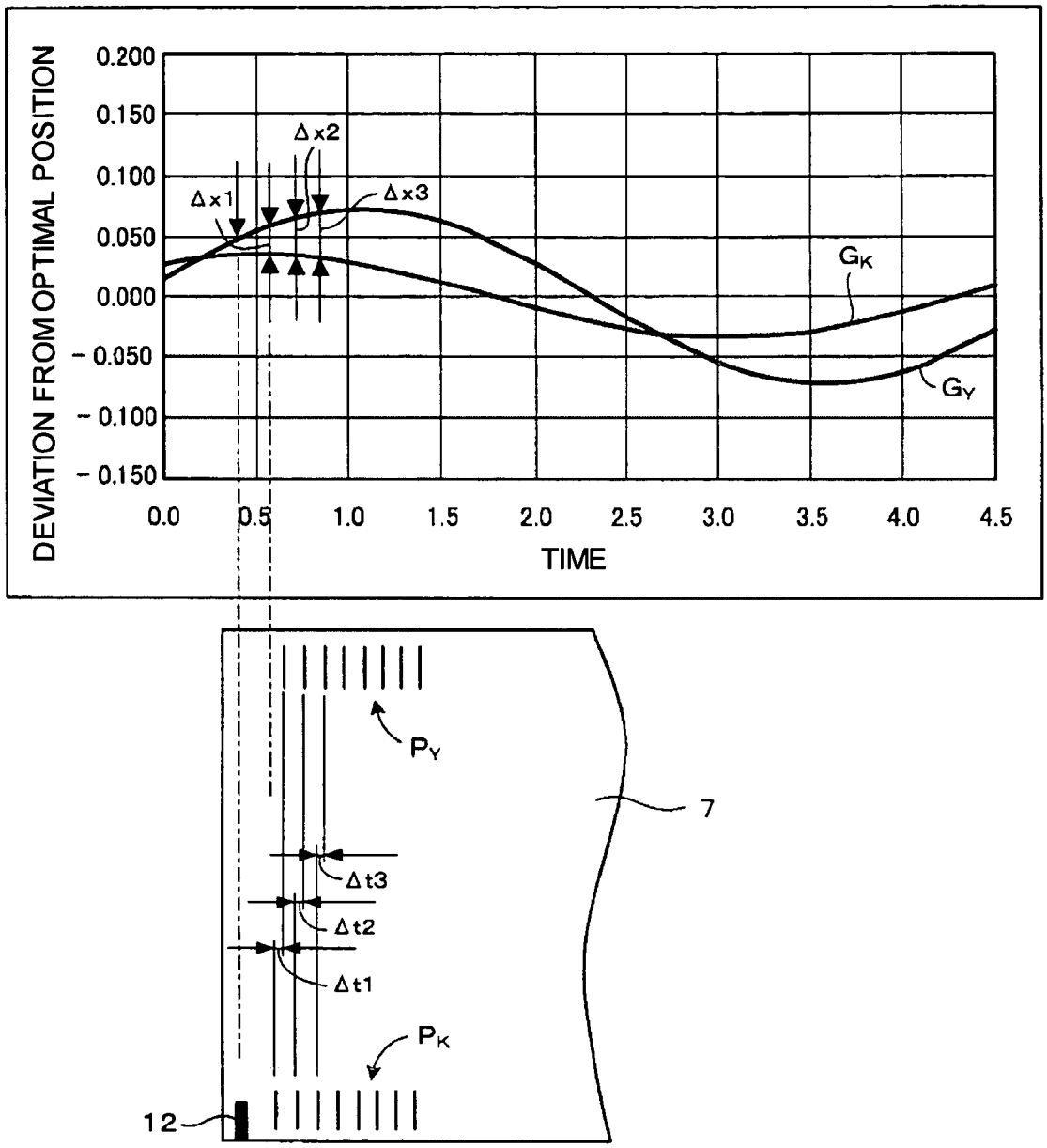
FIG. 5 is a graph that illustrates the difference of elapsed time between a black pattern and a yellow pattern.
Figure 6:
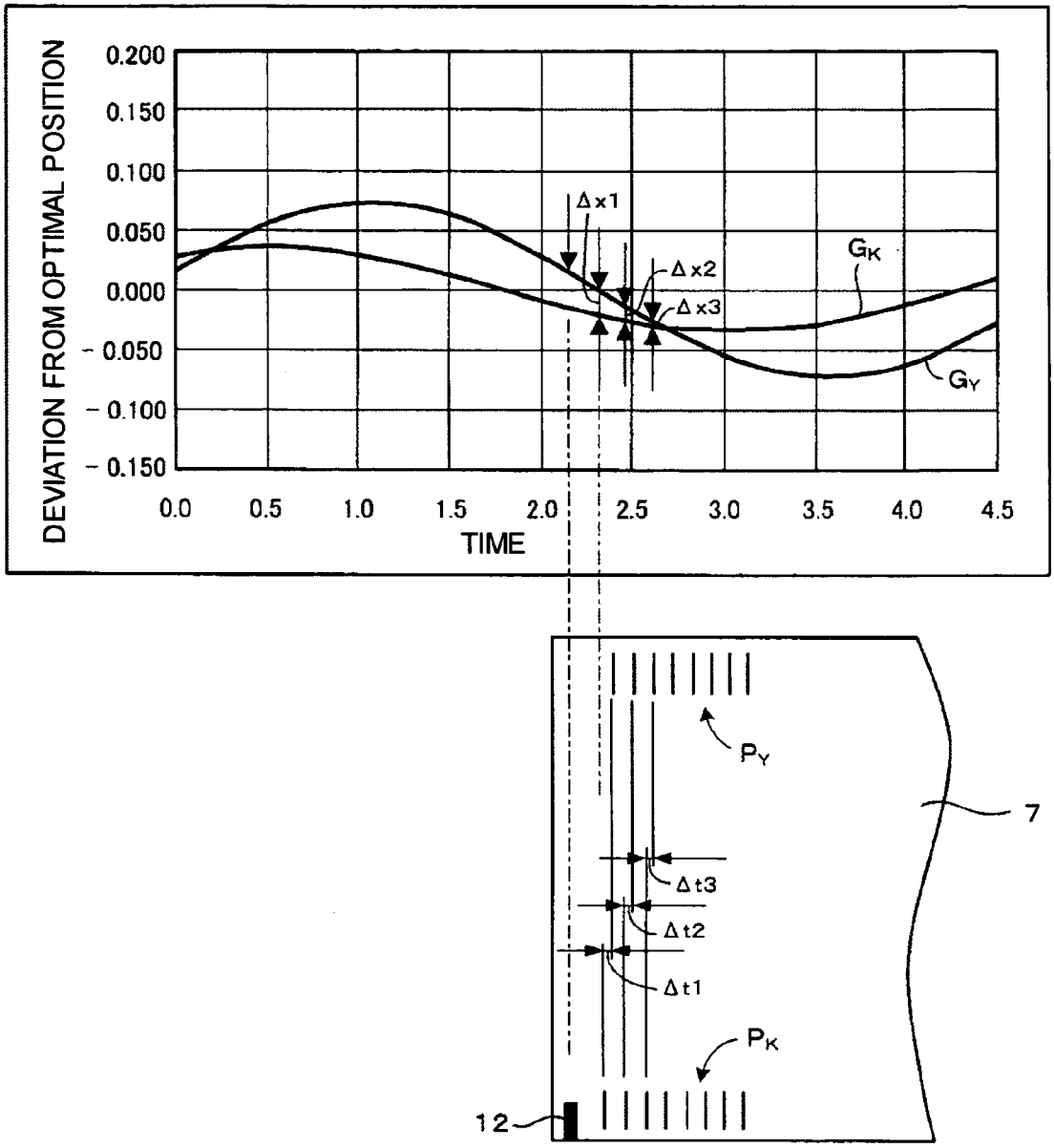
FIG. 6 is a graph that illustrates the difference of elapsed time between a black pattern and a yellow pattern, in which the patterns are formed near the intersection.

FIGS. 5 and 6 are graphs illustrating the difference of elapsed time between an example of a black pattern and a yellow pattern, in which Gk represents the positional deviation of the black line image Pk, and Gy represents the positional deviation of the yellow line image Py.

Both graphs only show the waveform having the largest period for simplification. However, in reality, there may be combined curves of waveforms having different frequencies caused by various factors.

The difference of elapsed time between each line in the reference black line image Pk and the corresponding line in the yellow line image Py may be calculated, and then the sum of the absolute values of time differences may be obtained. Thus, the time difference between the yellow line image Py and the black line image Pk, $\Delta T_{Y\text{-}K}$, can be expressed as follows:

$$\Delta T_{Y\text{-}K}=|\Delta t1|+|\Delta t2|+|\Delta t3|+\ .\ .\ .\ +|\Delta tn| \quad (12).$$

Thus, the time difference between each line may be first expressed as an absolute value before obtaining the sum. Otherwise, when the line images are formed near the intersection of Gy and Gk, between 2.5 and 3 on the time axis as shown in the graph of FIG. 6, the sum of the time differences may become extremely small, even though there is a positional deviation. This can give a false impression that the positions of the images have matched.

The color deviation of images in the direction of movement of the image transferring member (direction of secondary scanning) can be caused, for example, by the following factors:

- $\Delta t_{drX}$: Deviation caused by fluctuation in the rotational speed of an image carrying member, where X represents the color of the image carrying member. If yellow, X=Y,
- $\Delta t_{blt}$: Deviation caused by deviation in the thickness of the image transferring member,
- $\Delta t_{reg}$: Deviation caused by shift, and
- $\Delta t_{sq}$: Deviation caused by skew.

Eccentricity of the driving roller can also cause the deviation. However, this can be reduced or even prevented by making the length of the outer circumference of the driving roller the same as the distance between each image carrying member.

The sum, $\Delta T_{Y\text{-}K}$, of the deviations caused by the aforementioned factors may be expressed as follows:

$$\Delta T_{Y\text{-}K}=\Delta t_{dr\text{-}X}+\Delta t_{blt}+\Delta t_{reg}+\Delta t_{sq} \quad (13).$$

From the equations (12) and (13), the time difference of the yellow line image and the black line image can be expressed as follows:

$$|\Delta t1|+|\Delta t2|+|\Delta t3| \ldots +|\Delta tn|=\Delta t_{dr\text{-}X}+\Delta t_{blt}+\Delta t_{reg}+\Delta t_{sq} \quad (14).$$

In the equation (14), $\Delta t_{reg}$ and $\Delta t_{sq}$ often change due to rise in temperature of optical elements of the image writing device. However, since the patterns can be formed in short time, it can be assumed that the temperature does not rises much. Thus, $\Delta t_{reg}$ and $\Delta t_{sq}$ can be considered as constants.

Moreover, $\Delta t_{blt}$ can be maintained at a fixed value by constantly forming the patterns at the same position on the image transferring member. Therefore, assuming that $\Delta t_{blt}+\Delta t_{reg}+\Delta t_{sq}$ is a fixed value represented by k, the equation (14) can be rewritten as follows:

$$|\Delta t1|+|\Delta t2|+|\Delta t3|+ \ldots +|\Delta tn|=\Delta t_{dr\text{-}X}+k \quad (15).$$

The equation (15) provides the positional relation of the image-carrying-member driving-gears where the sum of the elapsed time differences between black lines and corresponding yellow lines is the relatively lowest or even the minimum. Hence, one can obtain the positional relation of the image carrying members where the deviation of line images caused by fluctuation in the rotational speed is the relatively lowest or even the minimum.

The difference, $\Delta T_{Y\text{-}K}$, may be calculated a few times while changing the rotational phase of the image carrying member (Y) against the reference image carrying member (K), by 1 or more degrees. The calculation results may then be stored in the memory. Then, the position of the image carrying member (Y) corresponding to the relatively lowest or even the minimum value of $\Delta T_{Y\text{-}K}$ may be designated, e.g. set, as the relatively optimal position, where the image is least likely to deviate. The relatively optimal position may be subsequently retained as the base position of the yellow-image carrying member, so that images can be formed without deviating.

Likewise, $\Delta T_{C\text{-}K}$ may be calculated for the cyan-image carrying member, $\Delta T_{M\text{-}K}$ may be calculated for the magenta-image carrying member, and the image carrying members may be adjusted to relatively optimal positions.

Thus, in t least one embodiment of the present invention, patterns are formed at the same position on the image transferring member by the following method. That is, the time required for the image transferring member to revolve once is obtained from the length of the circumference and the speed of the image transferring member. The time of one revolution is counted by a counter, and the next pattern is formed after the time of one revolution has elapsed.

The above method is inexpensive. However, slippage can occur between the image transferring member and the driving roller, resulting in a significant deviation if the image transferring member is delayed, etc. To reduce or even solve this problem, a protrusion or a marking, as a reference point, can be provided on the image carrying member or the image-carrying-member driving-gear. Such an arrangement allows relatively high precision of compensating for the positional deviation because the reference point is detected once every time the image carrying member is rotated.

Errors caused by slippage and the like can also be reduced by providing a protrusion or a marking as a reference point on the image transferring member, and forming the patterns after a reference point detecting unit, which may include a contact sensor, an optical sensor, etc., detects the reference point.

In the examples of FIGS. 5 and 6, Δx changes because the patterns are formed on different positions on the image transferring member.

Thus, at least one embodiment of the present invention allows reduction in the positional deviation of patterns formed on the image transferring member, caused by deviation of the thickness of the image transferring member.

Although the invention has been described with respect to at least one specific embodiment, for a complete and clear disclosure, the appended claims are not to be thus limited but are to be construed as embodying all modifications and alternative constructions that may occur to one skilled in the art that fairly fall within the basic teaching herein set forth.

Any of the aforementioned methods may be embodied in the form of a system or device, including, but not limited to, any of the structure for performing the methodology illustrated in the drawings.

Further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method of adjusting rotational phase of a plurality of image carrying members in an image forming apparatus including an image transferring member and a plurality of detecting units adapted to each detect a corresponding one of a plurality of reference points, each reference point corresponding to a reference rotational position of a corresponding image carrying member, the method comprising:

designating one image carrying member as a reference image carrying member;

forming, after detection of the reference rotational position of the corresponding image carrying member, a toner image of a pattern on each image carrying member and transferring the toner images onto the image transferring member;

detecting elapsed time differentials of each toner image transferred from the image carrying members other than the reference image carrying member based on the toner image transferred from the reference image carrying member, in a direction of movement at a fixed position on the image transferring member;

calculating a sum of absolute values of the elapsed time differentials for each toner image and storing the sums as fluctuations in rotational speed of each image carrying member;

adjusting rotational phases of the image carrying members, other than the reference image carrying member, with respect to a rotational phase of the reference image carrying member, and repeating the forming, the detecting, and the calculating at substantially the same position on the image transferring member, to thereby obtain fluctuations in the rotational speed of each image carrying member for a plurality of sets; and selecting the position where the fluctuation in the rotational speed is relatively lowest for each image carrying member.

2. The method according to claim 1, wherein one of the plurality of reference points is provided on each image carrying member.

3. The method according to claim 1, wherein the image forming apparatus further includes a plurality of driving members, each driving member being adapted to drive a corresponding image carrying member, and wherein one of the plurality of reference points is provided on each driving member.

4. The method according to claim 1, wherein at least one of the plurality of reference points is a protrusion.

5. The method according to claim 1, wherein at least one of the plurality of reference points is a marking.

6. The method according to claim 1, wherein the image transferring member is a belt, a length of the inner circumference of the belt is L, a thickness is d, a deviation of the thickness is Δd, a deviation of the position where the toner image is formed on the belt is ΔL, a distance between two adjacent image carrying members is p, and number of image carrying members is n, and wherein $$\Delta d/2\cdot((L/2\pi+d/2)/(r+d/2))\cdot(\sin((n-1)p/(L/2\pi+d/2)+(2\pi\cdot\Delta L/L)+\theta)-\sin((2\pi\cdot\Delta L/L)+\theta))<100\ \mu m.$$

7. The method according to claim 1, wherein the image transferring member is a belt made of a material that includes polyimide, a length of the inner circumference of the belt is L, a thickness is d, a deviation of the thickness is Δd, a deviation of the position where the toner image is formed on the belt is ΔL, a distance between two adjacent image carrying members is p, and number of image carrying members is n, and wherein $$(L/2\pi+d/2)/(r+d/2))\cdot(\sin((n-1)p/(L/2\pi+d/2)+(2\pi\cdot\Delta L/L)+\theta)-\sin((2\pi\Delta L/L)+\theta)<10\ \mu m.$$

8. A computer readable medium including program segments for, when executed on a computer device, causing the computer device to implement the method of claim 1.

9. A method of adjusting rotational phase of a plurality of image carrying members in an image forming apparatus, the image forming apparatus including an image transferring member and a detecting unit adapted to detect a reference point at a reference position on the image transferring member, the method comprising:

designating one image carrying member as a reference image carrying member;

forming, after the detecting unit detects the reference point, a toner image of a pattern on each image carrying member and transferring the toner images onto the image transferring member;

detecting elapsed time differentials of each toner image transferred from the image carrying members other than the reference image carrying member based on the toner image transferred from the reference image carrying member, in a direction of movement at a fixed position on the image transferring member;

calculating a sum of absolute values of the elapsed time differentials for each toner image and storing the sums as fluctuations in rotational speed of each image carrying member;

adjusting rotational phases of the image carrying members other than the reference image carrying member with respect to a rotational phase of the reference image carrying member, and repeating the forming, the detecting, and the calculating, to thereby obtain fluctuations in the rotational speed of each image carrying member for a plurality of sets; and selecting the position where the fluctuation in the rotational speed is relatively lowest for each image carrying member.

10. The method according to claim 9, wherein the reference point is a protrusion.

11. The method according to claim 9, wherein the reference point is a marking.

12. The method according to claim 9, wherein the image transferring member is a belt, a length of the inner circumference of the belt is L, a thickness is d, a deviation of the thickness is Δd, a deviation of the position where the toner image is formed on the belt is ΔL, a distance between two adjacent image carrying members is p, and number of image carrying members is n, and wherein $$\Delta d/2\cdot((L/2\pi+d/2)/(r+d/2))\cdot(\sin((n-1)p/(L/2\pi+d/2)+(2\pi\cdot\Delta L/L)+\theta)-\sin((2\pi\cdot\Delta L/L)+\theta))<100\ \mu m.$$

13. The method according to claim 9, wherein the image transferring member is a belt made of a material that includes polyimide, a length of the inner circumference of the belt is L, a thickness is d, a deviation of the thickness is Δd, a deviation of the position where the toner image is formed on the belt is ΔL, a distance between two adjacent image carrying members is p, and number of image carrying members is n, and wherein $$(L/2\pi+d/2)/(r+d/2))\cdot(\sin((n-1)p/(L/2\pi+d/2)+(2\pi\cdot\Delta L/L)+\theta)-\sin((2\pi\Delta L/L)+\theta)<10\ \mu m.$$

14. A computer readable medium including program segments for, when executed on a computer device, causing the computer device to implement the method of claim 9.

15. An image forming apparatus comprising:

a plurality of image carrying members;

an image transferring member on which are superimposed toner images that are formed on each of the image carrying members;

a plurality of detecting units, each detecting unit adapted to detect a corresponding reference point, wherein each reference point corresponds to a reference rotational position of a corresponding image carrying member; and means for (a) designating one image carrying member a reference image carrying member, for (b), after each detecting unit detects the reference rotational position of the corresponding image carrying member, forming a toner image of a patter on each image carrying member and for transferring the toner images onto the image transferring member, for (c) detecting elapsed time differentials of each toner image transferred from the image carrying members other than the reference image carrying member, based on the toner image transferred from the reference image carrying member and in a direction of movement at a fixed position on the image transferring member, for (d) calculating a sum of absolute values of the elapsed time differentials for each toner image and for storing the sums as fluctuations in rotational speed of each image carrying member, for (e), adjusting rotational phases of the image carrying members other than the reference image carrying member, with respect to a rotational phase of the reference image carrying member, and for repeating (b), (c), and (d) at substantially the same position on the image transferring member, to thereby obtain fluctuations in the rotational speed of each image carrying member for a plurality of sets, and for (f) selecting the position where the fluctuation in the rotational speed is relatively lowest for each image carrying member.

16. The image forming apparatus according to claim 15, wherein the plurality of image carrying members are configured as a process cartridge that includes a charging unit that electrically charges the image carrying members.

17. An image forming apparatus comprising:

a plurality of image carrying members;

an image transferring member on which are superimposed toner images that are formed on each of the image carrying members;

a detecting unit, adapted to detect a reference point, wherein the reference point corresponds to a reference position on the image transferring member; and means for (a) designating one image carrying member as a reference image carrying member, for (b), after the detecting unit detects the reference point, forming a toner image of a pattern on each image carrying member and for transferring the toner images onto the image transferring member, for (c) detecting elapsed time differentials of each toner image, transferred from the image carrying members other than the reference image carrying member, based on the toner image transferred from the reference image carrying member and in a direction of movement at a fixed position on the image transferring member, for (d) calculating a sum of absolute values of the elapsed time differentials for each toner image and for storing the sums as fluctuations in rotational speed of each image carrying member, for (e) adjusting rotational phases of the image carrying members, other than the reference image carrying member, with respect to a rotational phase of the reference image carrying member, and for repeating (b), (c), and (d) to thereby obtain fluctuations in the rotational speed of each image carrying member for a plurality of sets, and for (f) selecting the position where the fluctuation in the rotational speed is relatively lowest for each image carrying member.

18. The image forming apparatus according to claim 17, wherein the plurality of image carrying members are configured as a process cartridge that includes a charging unit that electrically charges the image carrying members.

19. A method of adjusting rotational phase of a plurality of image carrying members in an image forming apparatus including an image transferring member and a plurality of detecting units adapted to each detect a corresponding one of a plurality of reference points, each reference point corresponding to a reference rotational position of a corresponding image carrying member, the method comprising:

designating one image carrying member as a reference image carrying member;

forming a toner image of a pattern on each image carrying member and transferring the toner images onto the image transferring member;

detecting elapsed time differentials of each toner image transferred from the image carrying members other than the reference image carrying member based on the toner image transferred from the reference image carrying member;

calculating a sum of absolute values of the elapsed time differentials for each toner image; and adjusting rotational phases of the image carrying members other than the reference image carrying member based on the calculated sum of the elapsed time differentials for each toner image.

* * * * *